US006913479B1

(12) United States Patent
Su et al.

(10) Patent No.: US 6,913,479 B1
(45) Date of Patent: Jul. 5, 2005

(54) ELECTRONIC CARD CONNECTOR

(75) Inventors: Chia-Sheng Su, Tucheng (TW); Ming-Chun Lai, Tucheng (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 10/759,051

(22) Filed: Jan. 20, 2004

(51) Int. Cl.[7] ..... H01R 13/62
(52) U.S. Cl. ..... 439/326; 439/342
(58) Field of Search ..... 439/326, 630, 439/331, 341, 376, 342

(56) References Cited

U.S. PATENT DOCUMENTS

| | | | | |
|---|---|---|---|---|
| 5,813,878 | A * | 9/1998 | Kuwata et al. | 439/326 |
| 5,961,338 | A * | 10/1999 | Wu et al. | 439/326 |
| 5,984,707 | A * | 11/1999 | Kuwata | 439/326 |
| 5,996,891 | A * | 12/1999 | Braun | 235/441 |
| 6,024,593 | A * | 2/2000 | Hyland | 439/326 |
| 6,062,889 | A * | 5/2000 | Hyland et al. | 439/326 |
| 6,099,337 | A * | 8/2000 | Chan | 439/326 |
| 6,106,317 | A * | 8/2000 | Michaelis et al. | 439/326 |
| 6,149,466 | A * | 11/2000 | Bricaud et al. | 439/630 |
| 6,174,188 | B1 * | 1/2001 | Martucci | 439/326 |
| 6,176,721 | B1 * | 1/2001 | Gottardo et al. | 439/260 |
| 6,210,193 | B1 * | 4/2001 | Ito et al. | 439/326 |
| 6,220,882 | B1 * | 4/2001 | Simmel et al. | 439/326 |
| 6,231,365 | B1 * | 5/2001 | Konno et al. | 439/331 |
| 6,234,810 | B1 * | 5/2001 | Schnell et al. | 439/76.1 |
| 6,241,545 | B1 * | 6/2001 | Bricaud et al. | 439/326 |
| 6,273,739 | B1 * | 8/2001 | Konno et al. | 439/331 |
| 6,319,036 | B1 * | 11/2001 | Zheng et al. | 439/326 |
| 6,334,786 | B1 * | 1/2002 | Lee | 439/331 |
| 6,368,138 | B1 * | 4/2002 | Huang | 439/331 |
| 6,383,027 | B2 * | 5/2002 | Cabane et al. | 439/630 |
| 6,468,101 | B2 * | 10/2002 | Suzuki | 439/326 |
| 6,471,550 | B2 * | 10/2002 | Maiterth et al. | 439/631 |
| 6,663,408 | B2 * | 12/2003 | Sato | 439/331 |
| 6,719,579 | B2 * | 4/2004 | Tisserand et al. | 439/331 |
| 6,722,906 | B2 * | 4/2004 | Tsing | 439/260 |
| 6,743,035 | B1 * | 6/2004 | Yang | 439/326 |
| 6,761,575 | B2 * | 7/2004 | Bricaud et al. | 439/326 |
| 2003/0190832 | A1 * | 10/2003 | Matsunaga et al. | 439/331 |

* cited by examiner

*Primary Examiner*—Ross Gushi
(74) *Attorney, Agent, or Firm*—Rosenberg, Klein & Lee

(57) ABSTRACT

The present invention provides an electronic card connector which includes a base, a cover, a sliding mechanism, a holding mechanism and a pivotal member. The base received a number of contacts joins pivotally with the cover received an electronic card, and the contacts engage the electronic card for dates processing therebetween. The sliding mechanism forms where the base and the cover engage pivotally whereby the cover rotates with regard to the base from an opening status to a preliminary closing status. The holding mechanism is defined in the base and the cover whereby when the cover is horizontally rearward pushed from a preliminary closing status to a final closing status, an interlock therebetween is achieved. The pivotal member passes through the base and the cover to provide a reliable pivotal interconnection therebetween.

4 Claims, 4 Drawing Sheets

ELECTRONIC CARD CONNECTOR

BACKGROUND OF THE INVENTION

1. Field of the Invention

The present invention relates generally to an electronic card connector, and more especially to an electronic card connector which provides an improved interconnection mechanism thereof.

2. The Related Art

At present, a variety of electronic cards, such as memory card, IC card are used extensively following with a development of computers and peripherals for dates processing. Further, the electronic card connector has a correspondingly great development.

In general, as shown in FIG. 5, a common electronic card connector 10*a* which is applied to an electronic customer such as mobile phone, includes a housing 1*a*, a plurality of terminals 12*a* and a shield 2*a*. The terminals are received in the housing 1*a* for conducting electrically an electronic card (not shown) which is received in the shield 2*a*. The housing 1*a* is formed with a pair of sliding slots 13*a* and locking portions 16*a* in both sides. Correspondingly, the shield 2*a* extends downward a pair of lateral arms 21*a* and engaging portions 26*a* in both sides thereof. Further, the lateral arms 21*a* are shaped with a pair of protruding rotation shafts 23*a* for engaging pivotally with the each sliding slots 13*a* respectively. Thereby, the shield 2*a* could rotate pivotally from a perpendicular position to a horizontal position relative to the housing 1*a* for closing or opening the electronic card connector 10*a*.

In a using condition of the electronic card connector 10*a*, the shield 2*a* is rotated firstly from the perpendicular position to the horizontal position relative to the housing 1*a* around the rotation shafts 23*a* as a rotary axis. Then, the shield 2*a* is pushed rearward with a specific distance whereby the engaging portions 26*a* of the shield 2*a* interlock the locking portions 16*a* of the housing 1*a*. Thereby, an interlock is be achieved between the shield 2*a* and the housing 1*a*. Meanwhile, the electronic card conducts electrically the terminals 12*a*, which realizes a data processing therebetween.

However, as mentioned above, the shield 2*a* connects pivotally with the housing 1*a* through an interconnection between the rotation shafts 23*a* and the sliding slots 13*a*. In this consequence, the rotation shafts 23*a* are easy to lose engagement with the sliding slots 13*a* in the course of opening or closing the electronic card connector 10*a*. Thereby, the electronic card connector 10*a* described above couldn't provide a reliable pivotal interconnection between the housing 1*a* and the shield 2*a* by means of the prior art illustrated above.

SUMMARY OF THE INVENTION

Thus, an object of the present invention is to provide an electronic card connector which realizes a reliable pivotal interconnection between the housing and the shield in a using condition of the electronic card connector.

To attain the above object, the present invention provides an electronic card connector, which comprises a base, a cover, a sliding mechanism, a holding mechanism and a pivotal member. The base has a plurality of passageways for receiving a corresponding number of contacts therein. The cover joined pivotally with the base receives an electronic card which engages the contacts for dates processing therebetween. The sliding mechanism forms where the base and the cover engage pivotally, whereby, the cover rotates with regard to the base from an opening status to a preliminary closing status. The holding mechanism designs to keep a suitable distance with the sliding mechanism in the base and the cover, whereby when the cover is horizontally rearward pushed from the preliminary closing status to a final closing status, an interlock between the base and the cover is achieved. The pivotal member passes through the base and the cover for providing a pivotal interconnection therebetween.

As mentioned above, an obvious structure characteristic of the present invention is that the base joins pivotally with the cover through the pivotal member passing through therein. With this result, the cover can't deviate from the base to lose interconnection therebetween. Thereby, a reliable interconnection can be achieved between the base and the cover by the present invention.

BRIEF DESCRIPTION OF THE DRAWINGS

A detailed explanation of a preferred embodiment of the present invention will be given, with reference to the attached drawings, for better understanding thereof to those skilled in the art.

DETAILED DESCRIPTION OF THE PREFERRED EMBODIMENT

Figure 1:
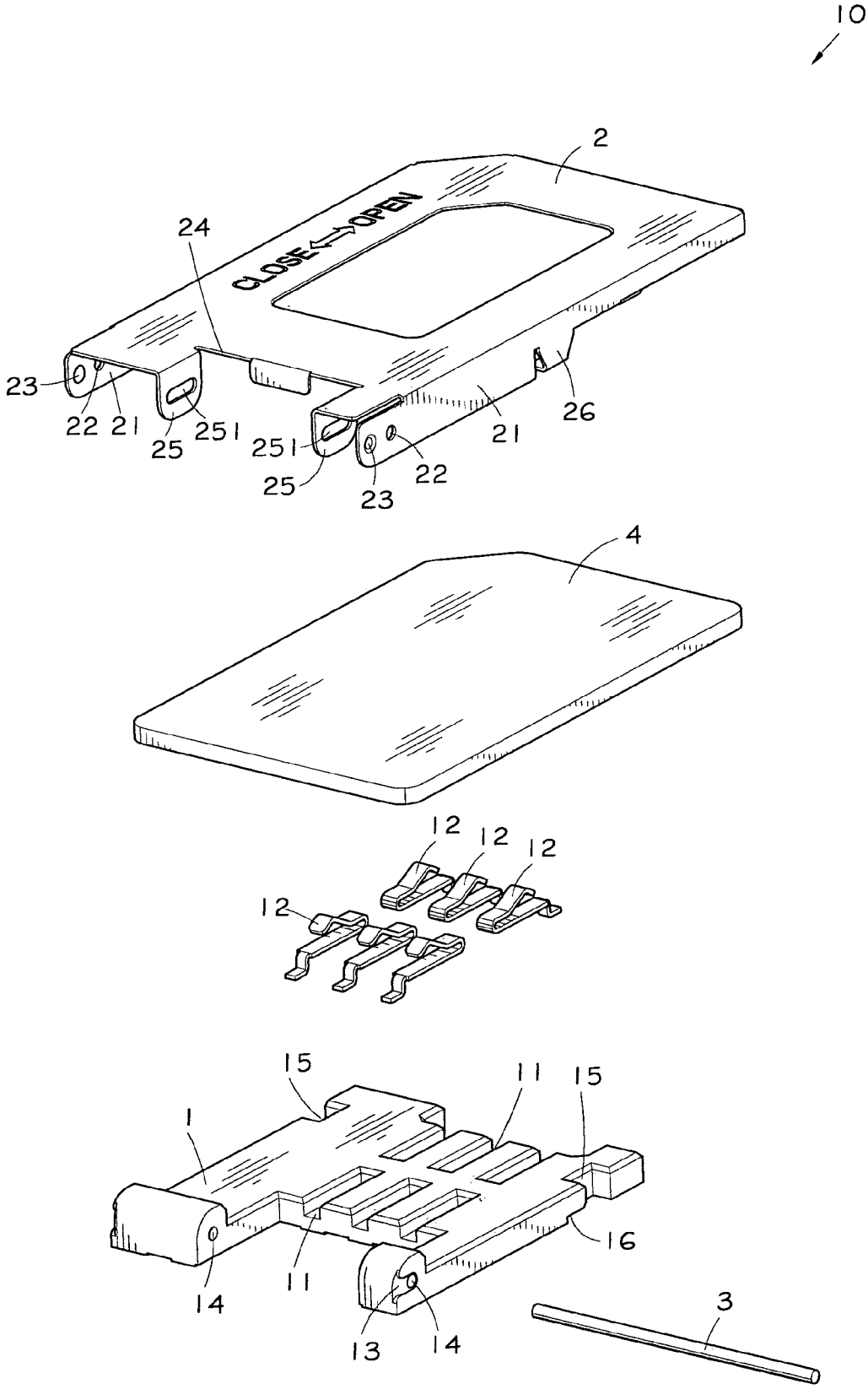
FIG. 1 (FIG. 1) is an exploded perspective view of an electronic card connector in accordance with the present invention.
Figure 2:
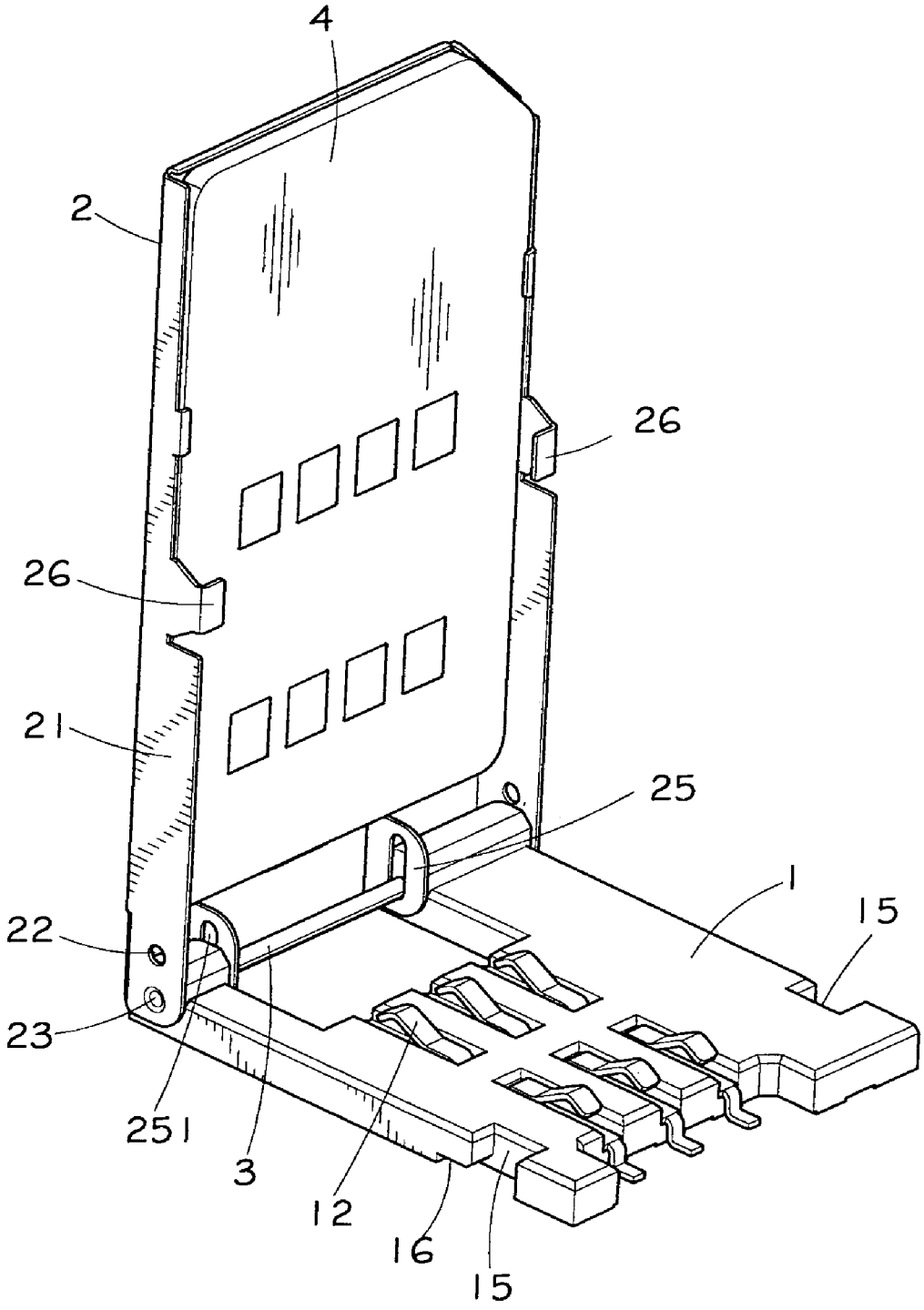
FIG. 2 (FIG. 2) is an assembled perspective view showing an opening status of the electronic card connector.

With reference to FIGS. 1 and 2, an electronic card connector utilized commonly in a mobile phone, in accordance with the present invention, generally designed with reference numeral 10, comprises a base 1 having a plurality of passageways 11 for receiving a corresponding number of contacts 12 therein. Correspondingly, a cover 2 is pivotally joined with the base 1. In this embodiment, the cover 2 is of a flat configuration, which extends downward a pair of lather boards 21 from the both sides thereof.

As shown in FIG. 1, the base 1 and the cover 2 are formed with a sliding mechanism where they engage pivotally. The sliding mechanism includes a pair of sliding grooves 13, pivotal holes 14, pass-through holes 22 and positioned shafts 23. The sliding grooves 13 are formed in the both outer sides of a behind portion of the base 1. The pivotal holes 14 are opened in the sliding grooves 13 and pass through transversely the behind portion of the base 1. Corresponding to the pivotal holes 14, the pass-through holes 22 are formed in the lather boards 21 of the cover 2 and passes through therein. The pair of positioned shafts 23 is integrally shaped with the lather boards 21 and opposite inward curved in adjacent to a rear part of the lather boards 21 which could slide movably front-to-back in the sliding grooves 13.

Referring to FIGS. 1 and 2 again, the cover 2 is opened to form a gap 24 in a rear part thereof, and bends downward to extend a pair of clipped boards 25 adjacent to the longitudinal sides of the gap 24. Further, the clipped boards 25 are opened to form a pair of longitudinal holes 251 with regard to the pass-through holes 22 and the positioned shafts 23. As assembling, a pivotal member such as a pass-through shaft 3 passes through respectively the pass-through hole 22, the pivotal hole 14 and the longitudinal hole 251, further passes through the whole base 1 and the cover 2 from one side to the other side. In this consequence, the base 1 and the cover 2 are interconnected pivotally by the pass-through shaft 3 and rotate relatively each other from an opening status shown in FIG. 2 to a preliminary closing status shown in FIG. 3.

As illustrated in the embodiment, the base 1 and the cover 2 are further formed with a holding mechanism which is designed to keep a suitable distance with the sliding mechanism. The holding mechanism includes a pair of receiving recesses 15, holding recesses 16 and locking boards 26. The receiving recesses 15 are formed in the both lather sides of the base 1 and pass through upward and downward the top and bottom surfaces of the base 1. The holding recesses 16 are opened in the bottom surface of the base 1 adjacent to the receiving recesses 15 and communicate with the bottom surface of the base 1 and the receiving recesses 15. The locking boards 26 are opposite inward bent from a bottom edge of each lather boards 21.

Figure 3:
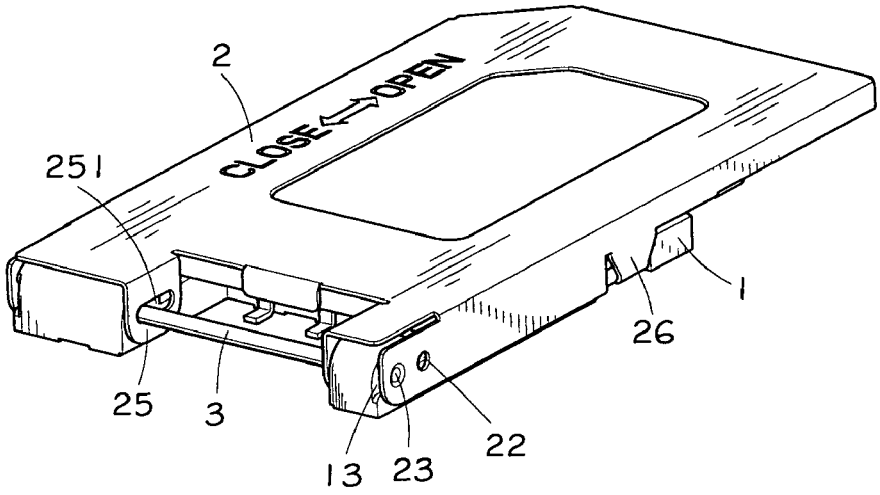
FIG. 3 (FIG. 3) is a perspective view showing a preliminary closing status of the electronic card connector.
Figure 4:
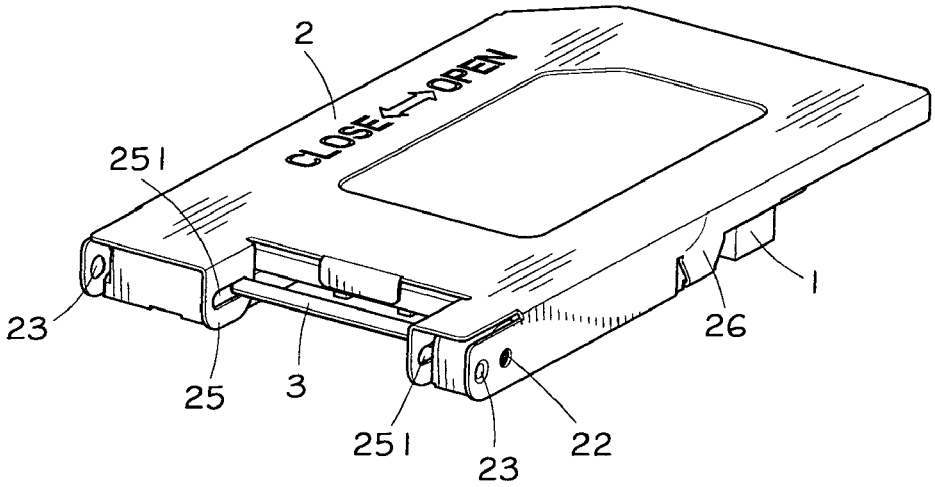
FIG. 4 (FIG. 4) is a perspective view showing a final closing status of the electronic card connector.
Figure 5:
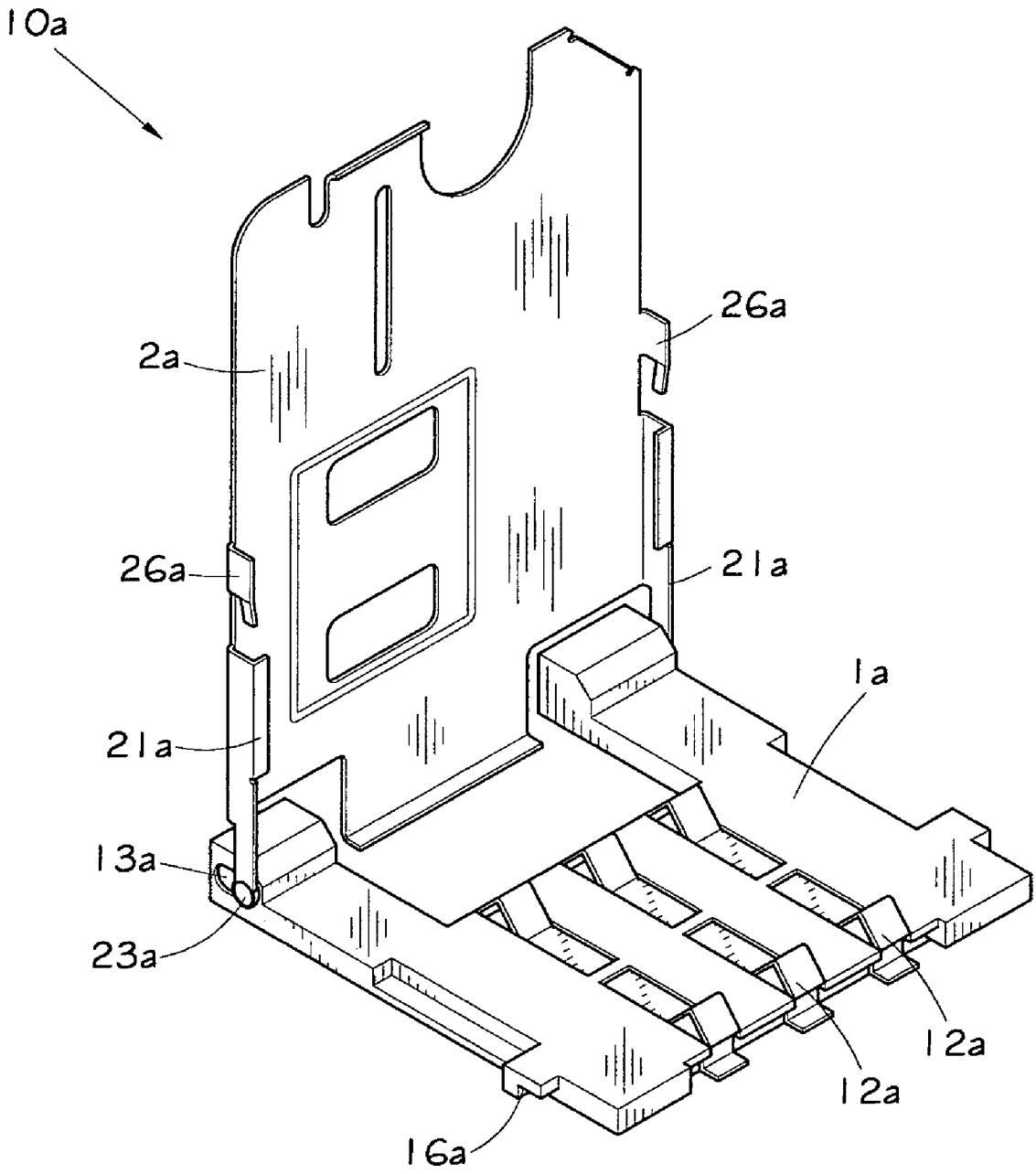
FIG.5 PRIOR ART
FIG. 5 (FIG. 5) is an electronic card connector in the prior art.

Referring now to FIGS. 2, 3 and 4, in a common application of the electronic card connector 10 of the present invention, the cover 2 is rotated pivotally to a slanted position with regard to the base 1, and the positioned shafts 23 contact collinearly the pass-through shaft 3, as shown in FIG. 2. As the electronic card 4 such as a SIM card is inserted into the cover 2, the cover 2 with the associated electronic card 4 is downward rotated toward the base 1 until the locking boards 26 are received in the receiving holes 15, as shown in FIG. 3.

Under this preliminary closing condition illustrated in FIG. 3, the cover 2 with the associated electronic card 4 is horizontally rearward moved with regard to the base 1 by applying a proper push force thereto. With this result, as shown in FIG. 4, the locking boards 26 enter the holding recesses 16, and the positioned shafts 23 move rearward to depart from the pass-through shaft 3 in the sliding holes 14. Meanwhile, the electronic card 4 engages mechanically and electrically the plurality of contacts 11 for dates processing therebetween. In this way, the cover 2 can't be lifted and rotated upward from the base 1 by means of an interlock between the holding recesses 16 and the locking boards 26.

In the process of the electronic card connector 10 operating as described above, because the base 1 joins pivotally with the cover 2 through the pass-through shaft 3 passing through therein, the cover can't deviate from the base 1 to lose interconnection. Thereby, a reliable pivotal interconnection can be achieved between the base 1 and the cover 2 by the present invention.

Although a particular embodiment of the invention has been described in detail for purposes of illustration, additional advantages and modifications will readily appear to those skilled in the art, and various modifications and enhancements may be made without departing from the spirit and scope of the invention. Accordingly, the invention is not to be limited except as by the appended claims.

What is claimed is:

1. An electronic card connector comprising:

a base having a plurality of passageways for receiving a corresponding number of contacts therein;

a cover joined pivotally with the base for receiving an electronic card which engages the contacts for dates processing therebetween;

a sliding mechanism formed where the base and the cover engage pivotally, whereby the cover rotates with regard to the base from an opening status to a preliminary closing status;

a holding mechanism keeping a distance with the sliding mechanism in the base and the cover, whereby, when the cover is horizontally rearward pushed from the preliminary closing status to a final closing status, an interlock between the base and the cover is achieved; and a pivotal member passing through the entire base and the cover from one side to another side to provide an pivotal interconnection therebetween.

2. The electronic card connector as claimed in claim 1, wherein the sliding mechanism includes a pair of sliding grooves, pivotal holes, pass-through holes and positioned shafts, the sliding grooves are formed in both outer sides of a behind portion of the base; the pivotal holes are opened in the sliding grooves and pass through transversely the behind portion of the base; the pass-through holes are formed in lather boards of the cover and pass through therein corresponding to the pivotal holes; the pair of positioned shafts are integrally shaped with the cover lather boards and opposite inward curved in adjacent to a rear part of the cover lather boards, whereby the positioned shafts could slide in the sliding grooves and the pivotal member passes through the pass-through holes and the pivotal holes.

3. The electronic card connector as claimed in claim 1, wherein the cover is opened to form a gap in a rear part thereof and bends downward to extend a pair of clipped boards adjacent to the gap longitudinal sides, the clipped boards are opened to form a pair of longitudinal holes for the pivotal member passing through.

4. The electronic card connector as claimed in claim 1, wherein the holding mechanism includes a pair of receiving recesses, holding recesses and locking boards, the receiving recesses are formed in both lather sides of the base and pass through top and bottom surfaces of the base; the holding recesses are opened in the base bottom surface and communicate with the base bottom surface and the receiving recesses; the locking boards are opposite inward bent from a bottom edge of each lather sides of the cover, whereby the locking boards are received in the receiving recesses in the preliminary closing status, further enter the holding recesses in the final closing status.

* * * * *